US009302875B2

(12) United States Patent
Whitten et al.

(10) Patent No.: US 9,302,875 B2
(45) Date of Patent: Apr. 5, 2016

(54) METHOD AND APPARATUS FOR DIVERTING SIGNATURES IN A FOLDER

(75) Inventors: David Elliott Whitten, Barrington, NH (US); Joseph Adrian St Ours, Lee, NH (US); Gerald Roger Douillard, Manchester, NH (US)

(73) Assignee: Goss International Americas, Inc., Durham, NH (US)

( * ) Notice: Subject to any disclaimer, the term of this patent is extended or adjusted under 35 U.S.C. 154(b) by 841 days.

(21) Appl. No.: 13/031,842

(22) Filed: Feb. 22, 2011

(65) Prior Publication Data

US 2012/0211936 A1 Aug. 23, 2012

(51) Int. Cl.

| | |
|---|---|
| ***B65H 39/10*** | (2006.01) |
| ***B65H 29/58*** | (2006.01) |
| ***B65H 5/36*** | (2006.01) |
| ***B65H 29/12*** | (2006.01) |

(52) U.S. Cl.

CPC ..... *B65H 29/58* (2013.01); *B65H 5/36* (2013.01); *B65H 29/12* (2013.01); *B65H 2301/34* (2013.01); *B65H 2301/342* (2013.01); *B65H 2301/3422* (2013.01); *B65H 2301/44552* (2013.01); *B65H 2404/1414* (2013.01); *B65H 2404/1415* (2013.01); *B65H 2404/63* (2013.01); *B65H 2404/632* (2013.01); *B65H 2404/74* (2013.01); *B65H 2404/741* (2013.01); *B65H 2404/7414* (2013.01); *B65H 2801/21* (2013.01)

(58) Field of Classification Search

CPC ..... B65H 5/36; B65H 29/12; B65H 29/58; B65H 2301/34; B65H 2301/342; B65H 2301/3422; B65H 2301/4455; B65H 2301/44552; B65H 2404/63; B65H 2404/632; B65H 2404/633; B65H 2404/74; B65H 2404/741; B65H 2404/7414; B65H 2404/7431; B65H 2404/1414; B65H 2404/1415

USPC ..... 271/302, 303

See application file for complete search history.

(56) References Cited

U.S. PATENT DOCUMENTS

| | | | | |
|---|---|---|---|---|
| 3,607,583 A | | 9/1971 | Geschwender | 156/596 |
| 4,373,713 A | * | 2/1983 | Loebach | B65H 29/58 271/182 |
| 4,538,800 A | | 9/1985 | Richter | |

(Continued)

FOREIGN PATENT DOCUMENTS

EP 0054963 A1 6/1982

OTHER PUBLICATIONS

Goss International Sunday 2000 and 3000 Gapless Wed Offset Press Systems.

(Continued)

*Primary Examiner* — Prasad Gokhale

(74) *Attorney, Agent, or Firm* — Davidson, Davidson & Kappel, LLC

(57) ABSTRACT

An apparatus for transporting signatures is provided which includes a moving transport surface for transporting signatures; a pair of eccentric guide rollers, rotatable about respective axes, the pair of guide rollers positioned opposite one another to receive signatures therebetween from the moving transport surface; and a diverter positioned downstream of the guide rollers. The diverter is movable between a first position to divert signatures received from the guide rollers to a first downstream moving transport surface and a second position to divert signatures received from the guide rollers to a second downstream moving transport surface.

19 Claims, 5 Drawing Sheets

(56) References Cited

U.S. PATENT DOCUMENTS

| | | | | | |
|---|---|---|---|---|---|
| 4,729,282 | A * | 3/1988 | Kasdorf | B65H 29/58 | 271/302 |
| 5,112,033 | A | 5/1992 | Breton | 270/47 | |
| 5,236,188 | A | 8/1993 | Breton et al. | 271/187 | |
| 5,467,976 | A | 11/1995 | Doucet | 271/13 | |
| 5,615,878 | A | 4/1997 | Belanger et al. | 271/302 | |
| 5,653,428 | A | 8/1997 | Dufour et al. | 270/6 | |
| 5,702,100 | A | 12/1997 | Novick et al. | 271/302 | |
| 6,007,064 | A | 12/1999 | Cote et al. | 271/279 | |
| 6,129,352 | A * | 10/2000 | Stab | B65H 29/58 | 271/302 |
| 6,254,093 | B1 * | 7/2001 | d'Agrella | B65H 29/58 | 271/193 |
| 6,302,392 | B1 * | 10/2001 | Schaefer | B65H 29/60 | 271/186 |
| 6,525,812 | B1 | 2/2003 | Hartmann et al. | 356/318 | |
| 7,765,908 | B1 | 8/2010 | Hearn | 83/347 | |
| 2002/0071691 | A1 | 6/2002 | Jones et al. | 399/91 | |
| 2002/0074721 | A1 * | 6/2002 | Schaefer | B65H 29/60 | 271/302 |
| 2002/0109290 | A1 * | 8/2002 | Wurschum | B65H 29/58 | 271/303 |
| 2007/0257426 | A1 * | 11/2007 | DeGruchy | B65H 29/58 | 271/303 |
| 2008/0001350 | A1 | 1/2008 | Okamoto | | |
| 2009/0038454 | A1 | 2/2009 | St. Ours et al. | 83/78 | |
| 2009/0127763 | A1 | 5/2009 | Cossette | 270/21.1 | |
| 2009/0217833 | A1 | 9/2009 | St. Ours et al. | 101/232 | |
| 2009/0315255 | A1 | 12/2009 | St. Ours et al. | 271/279 | |
| 2010/0201056 | A1 | 8/2010 | Dawley | 270/21.1 | |
| 2010/0201058 | A1 | 8/2010 | Dawley et al. | 270/52.17 | |
| 2010/0201065 | A1 | 8/2010 | Dawley et al. | 271/278 | |
| 2010/0201066 | A1 | 8/2010 | Dawley | 271/279 | |
| 2010/0288145 | A1 | 11/2010 | St. Ours | 101/227 | |

OTHER PUBLICATIONS

Goss International Sunday 4000 and 5000 Gapless Wed Offset Press Systems.

* cited by examiner

METHOD AND APPARATUS FOR DIVERTING SIGNATURES IN A FOLDER

This application relates to the field of printing presses, and in particular to the folders for printing presses.

BACKGROUND INFORMATION

In a web printing press, a web or webs may be printed in various printing units. The webs may then be folded and cut into signatures by a folder. It is often desirable to divide the signatures into two product streams for further processing.

U.S. Pat. No. 4,729,282 discusses a sheet diverter, adapted for cooperative association with a cutter in a pinless folder. A stationary triangular diverter deflects signatures into one of two guide paths. An oscillating diverter guide member, composed of a pair of diverter rolls forming a nip, guide the signatures to one side or the other of the triangular diverter. The diverter rolls are described as counter-rotating eccentric rolls which create a linear reciprocation of the nip defined by the two rolls.

U.S. Pat. No. 4,373,713 discusses a diverter mechanism which includes a stationary, substantially triangular diverter which deflects signatures into one of two guide paths. A pair of guide rolls each have a raised cam portion and a recessed portion which cooperate to guide signatures to one side or the other of the stationary diverter.

U.S. Pat. No. 5,467,976 discusses a diverter mechanism in which includes diverting tapes which are diverted from a position along a horizontal transport path to a position along an inclined transport path, and vice versa, by levers which are swivelably mounted on stationary axes.

BRIEF SUMMARY OF THE INVENTION

In accordance with an embodiment of the present invention, an apparatus for transporting signatures comprises a moving transport surface for transporting signatures; a pair of eccentric guide rollers, rotatable about respective axes, the pair of guide rollers positioned opposite one another to receive signatures therebetween from the moving transport surface; and a diverter positioned downstream of the guide rollers. The diverter is movable between a first position to divert signatures received from the guide rollers to a first downstream moving transport surface and a second position to divert signatures received from the guide rollers to a second downstream moving transport surface. The combination of eccentric guide rollers and a movable diverter provides a number of advantages, including the ability to reduce the space between signatures, and the ability to selectively divert the signatures one or two at a time to each downstream transport surface.

Each of the eccentric guide rollers may include a first outer circumferential surface having an eccentric protrusion and a second outer circumferential surface recessed relative to the first outer circumferential surface. The eccentric protrusion may be tapered from a first height to a second height, greater than the first height. The eccentric guide rollers may be positioned such that, as the guide rollers rotate, the first outer circumferential surface of one guide roller faces the second outer circumferential surface of the other guide roller.

The eccentric guide rollers may also include a plurality of lobes, where each of the lobes is separated from an adjacent lobe by a space, and where each of the plurality of lobes including a first outer circumferential surface having an eccentric protrusion and a second outer circumferential surface recessed relative to the first outer circumferential surface, the eccentric protrusion being tapered from a first height to a second height.

The diverter may be substantially triangular in shape, and may include a plurality of substantially triangular extensions having spaces therebetween, the spaces aligned with the plurality of lobes.

The moving transport surface may include a plurality of first transport tapes and a plurality of second transport tapes transporting signatures therebetween. The plurality of first transport tapes may pass through the spaces in one of the eccentric guide rollers and the plurality of second transport tapes may pass through spaces in the other eccentric guide roller. A plurality of third transport tapes and a plurality of fourth transport tapes may also be provided downstream of the diverter. The plurality of first transport tapes and the plurality of third transport tapes may form the first downstream moving transport surface, and the plurality of second transport tapes and the plurality of fourth transport tapes may form the second downstream moving transport surface.

In accordance with another embodiment of the present invention, a method for transporting signatures comprises moving signatures along a common transport path; rotating a pair of eccentric guide rollers, about respective axes, the pair of guide rollers positioned opposite one another to receive signatures therebetween from the common transport path; and moving a diverter positioned downstream of the guide rollers between a first position to divert signatures received from the guide rollers to a first downstream transport path and a second position to divert signatures received from the guide rollers to a second downstream transport path. The diverter and guide rollers may be constructed in the manner described above. Similarly, the common transport path may be comprised of the moving transport surface, and the first and second downstream transport paths may be comprised of the first and second downstream moving transport surfaces, as described above.

BRIEF DESCRIPTION OF THE DRAWINGS

The present invention will be further described with respect the following Figures, in which.

DETAILED DESCRIPTION OF A PREFERRED EMBODIMENT

Figure 1:
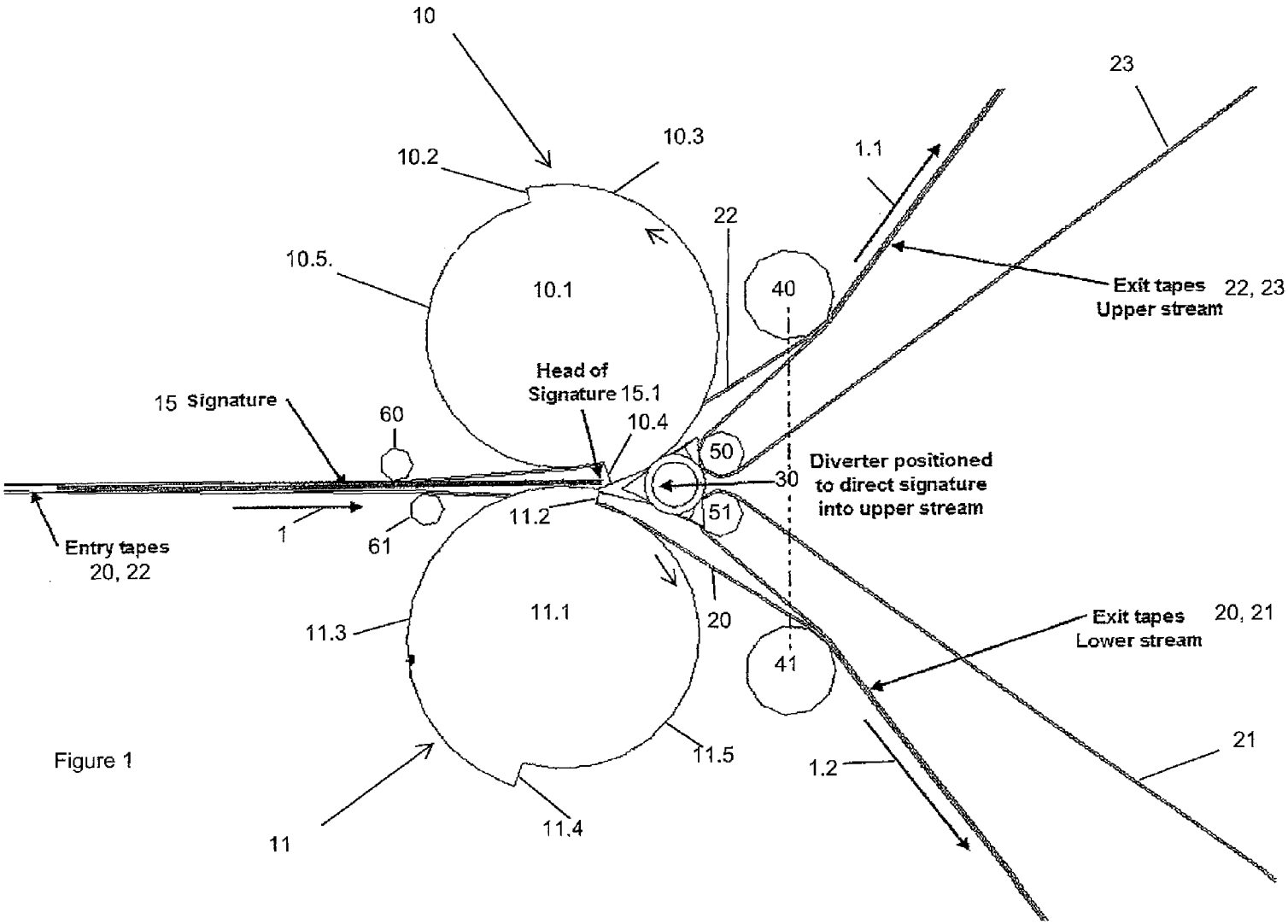
FIG. 1 shows a diverter mechanism just prior to diverting a signature to an upper signature stream.

A preferred embodiment of the present invention described below in connection with the drawings which illustrate a diverter mechanism 100 which includes a moving transport surface (such as opposed tapes 20, 22) for transporting signatures, a pair of eccentric guide rollers (such as eccentric rollers 10, 11), rotatable about respective axes (such as axes 16, 17), and a diverter (such as diverter 30) positioned downstream of the guide rollers, a first downstream moving transport surface (such as opposed tapes 22, 23) and a second downstream moving transport surface (such as opposed tapes 20, 21).

Figure 2:
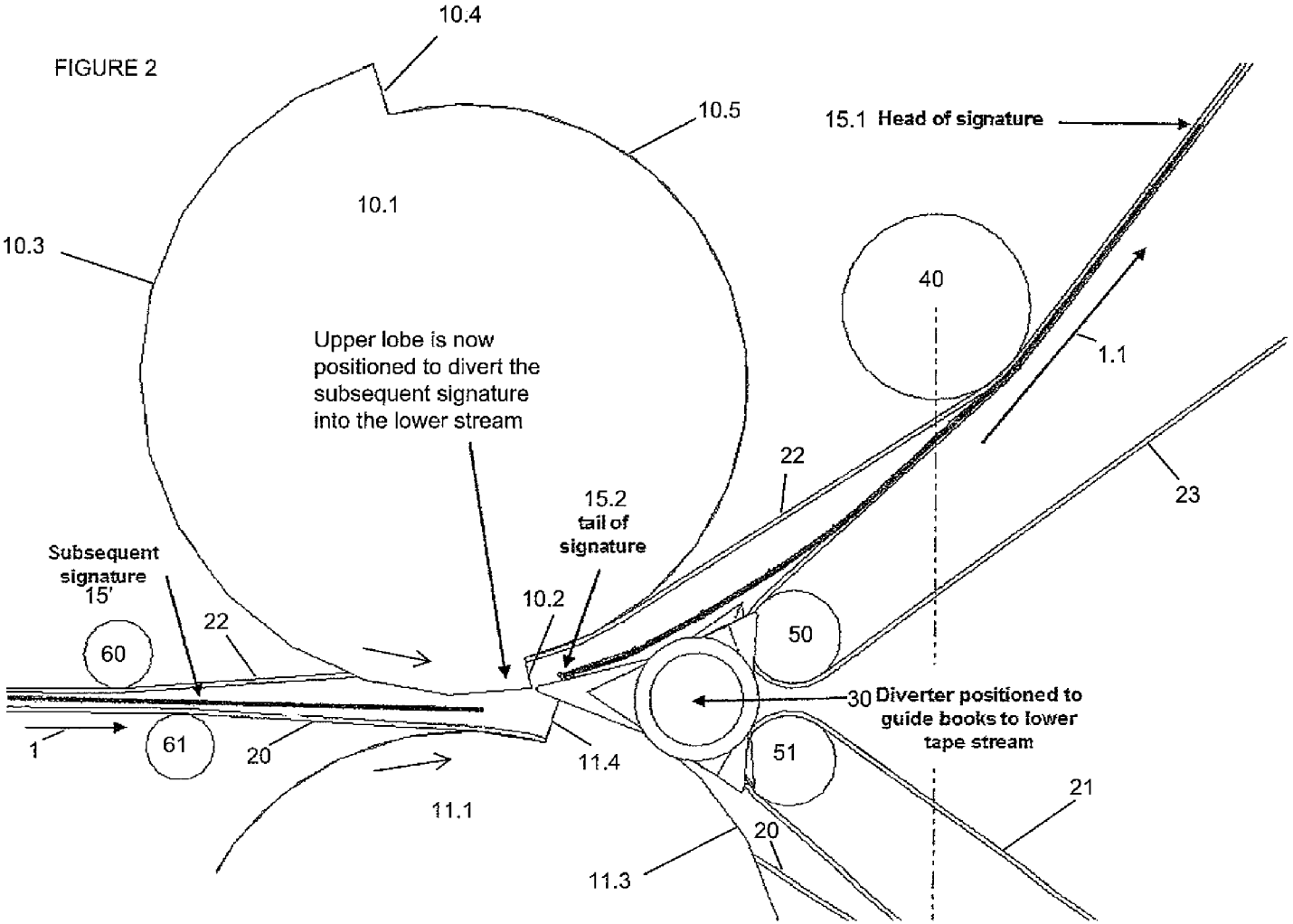
FIG. 2 shows the diverter mechanism of FIG. 1 just prior to diverting a subsequent signature to a lower signature stream.

FIGS. 1 through 5 show the diverter mechanism 100 for splitting a stream of signatures 15 into an upper stream and a lower stream. FIG. 1 shows the diverter mechanism 100 just prior to diverting a signature 15 to an upper signature stream traveling between tapes 22, 23, and FIG. 2 shows the diverter mechanism 100 just prior to diverting a subsequent signature 15' to a lower signature stream traveling between tapes 20, 21.

Referring to FIGS. 1 and 2, signatures 15 enter the diverting mechanism via a plurality of first transport tapes 20 and an opposing plurality of second transport tapes 22, moving in the direction 1. The signatures are then diverted by the diverter mechanism 100 to either an upper signature stream under the control of opposing tapes 22, 23, or to a lower signature stream under the control of opposing tapes 20, 21.

The diverter mechanism includes a pair of rotating eccentric guide rolls 10, 11 and a diverter 30. Rotating eccentric guide roll 10 has a plurality of axially arranged lobes 10.1, and is mounted for counterclockwise rotation about axis 16, and identical rotating eccentric guide roll 11 has a plurality of axially arranged lobes 11.1 is eccentrically mounted for clockwise rotation about axis 17. This is most clearly shown in FIG. 3, which illustrates a perspective view of the rolls 10, 11, and diverter 30, with three lobes 10.1 omitted to better view diverter 30, and in FIG. 4 which shows a roll 10 or 11 with its drive axis 16 or 17.

Figure 3:
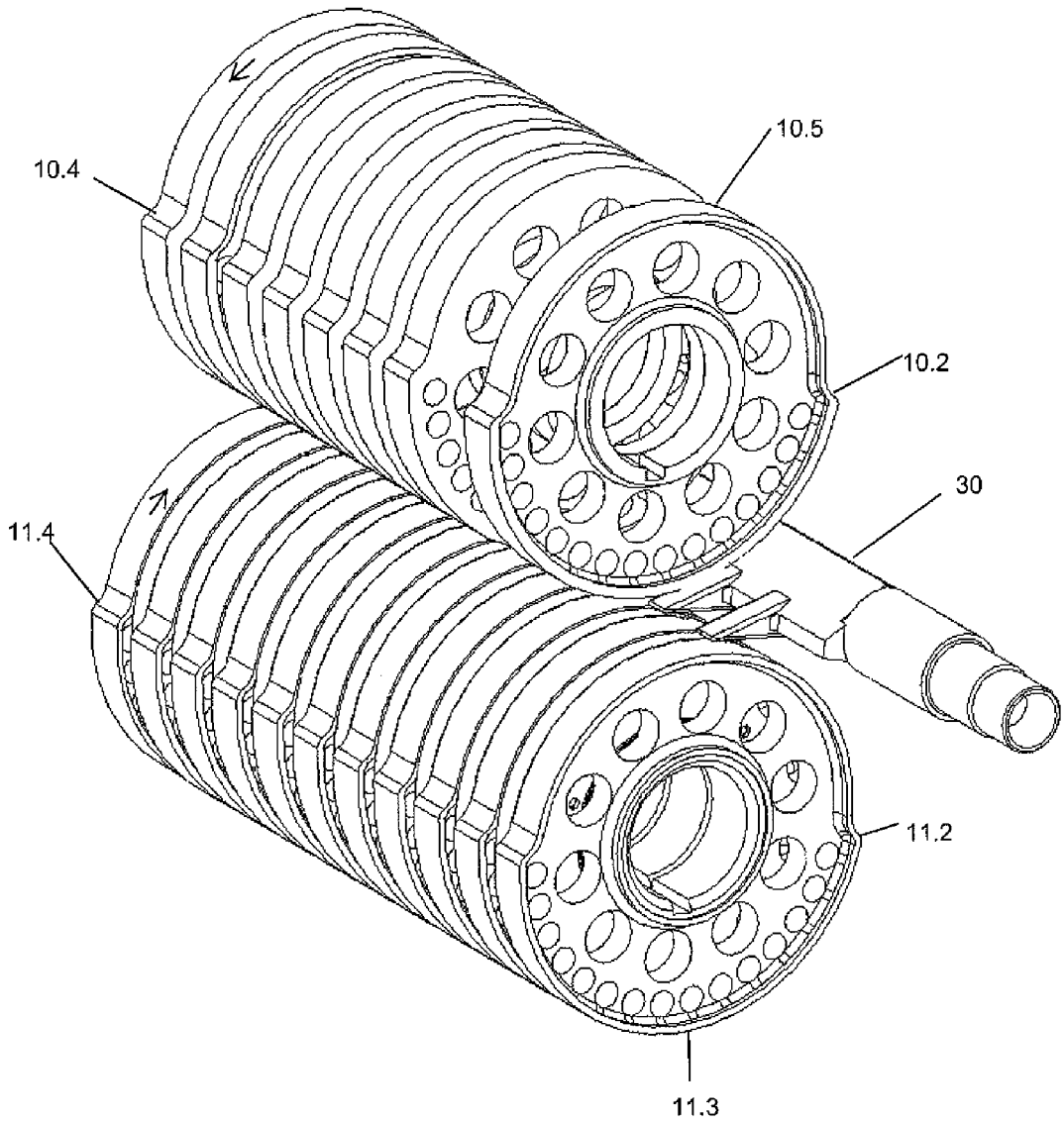
FIG. 3 shows an exemplary pair of eccentric rollers and a diverter of FIGS. 1 and 2 in perspective view.
Figure 4:
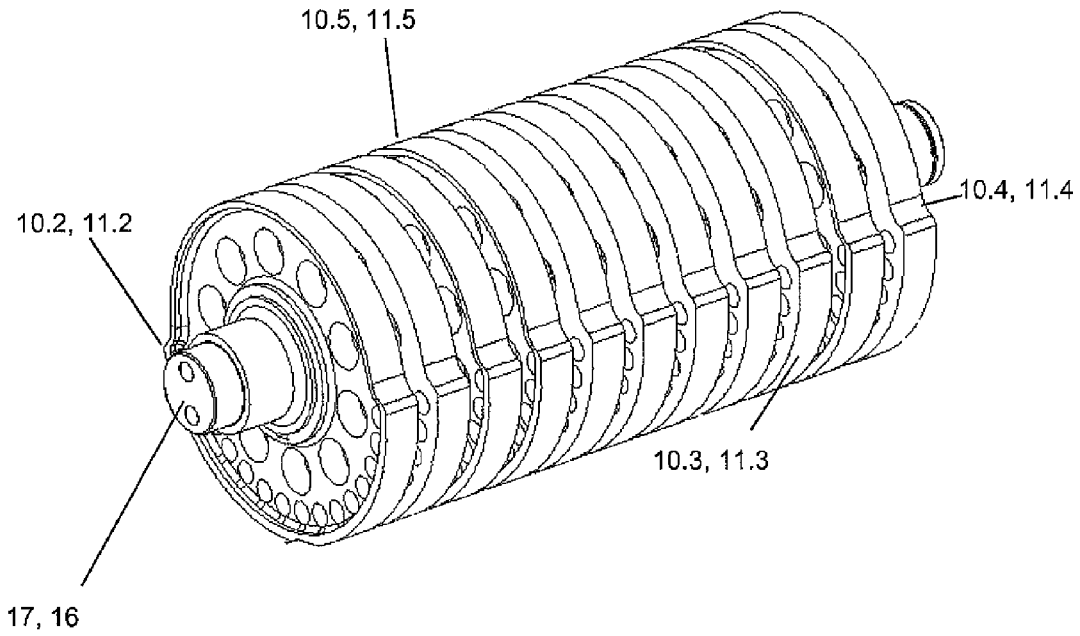
FIG. 4 shows an eccentric roller of FIG. 3.

Lobes 10.1 include a circular recessed portion 10.5 and a protruding eccentric portion 10.3. In the illustrated embodiments, the eccentric portion 11.3 is tapered from a maximum protrusion 10.4 to a minimum protrusion 10.2. Each of the second transport tapes 22 passes through a space between adjacent lobes 10.1. These spaces are shown in FIGS. 3 and 4. Similarly, lobes 11.1 include a circular recessed portion 11.5 and a protruding eccentric portion 11.3, the eccentric portion 11.3 is tapered from a maximum protrusion 11.4 to a minimum protrusion 11.2. Each of the first transport tapes 20 passes through a space between adjacent lobes 11.1.

Tapes 22 travel from roller 60 to guide roll 10, which deflects it to roller 40 of the upper signature stream path. Tapes 23 travel around roller 50 and are deflected by roller 40, at which point tapes 22, 23 travel in the direction 1.1 with signatures secured between them. Tapes 20 travel from roller 61 to guide roll 11, which deflects them to roller 41 of the lower signature stream path. Tapes 21 travel around roller 51 and are deflected by roller 41, at which point tapes 20, 21 travel in the direction 1.2 with signatures secured between them.

Figure 5:
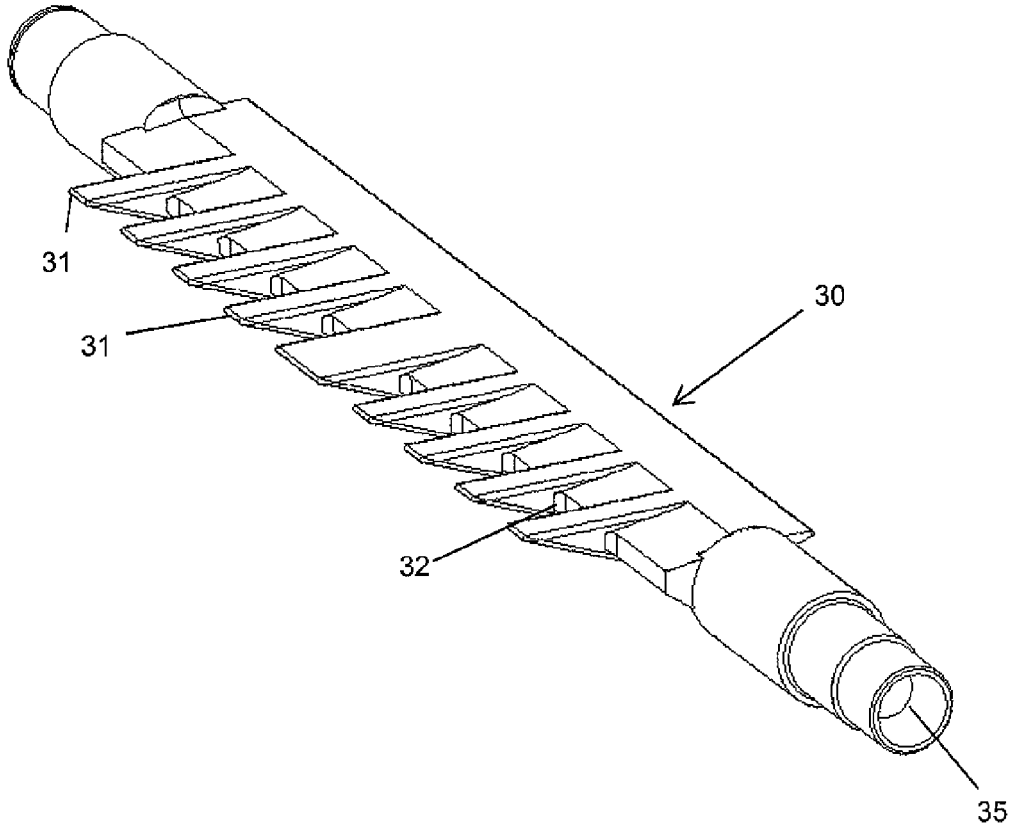
FIG. 5 shows the diverter of FIG. 3.

Diverter 30, illustrated in FIGS. 1, 2, 3, and 5, is positioned immediately downstream of the guide rolls 10, 11, and is rotatable about axis 35 between a first position, shown in FIG. 1, to guide a signature to the upper signature stream, and a second position, shown in FIG. 2, to guide a signature to the lower signature stream. As shown in FIG. 5, diverter 30 has a plurality of substantially triangular extensions 31 separated by adjacent recesses 32. As shown in FIGS. 1, 2, and 3, the extensions 31 are positioned so that they can be received in the spaces between adjacent lobes 10.1, 11.1.

In FIG. 1, the diverter mechanism 100 is illustrated in position to divert a signature 15 to the upper signature stream path in direction 1.1. Diverter 30 is in its first position, with it is extensions 31 closer to lobes 11.1. As the head 15.1 of the signature 15 approaches the diverter 30, the eccentric protrusion 11.3 of eccentric guide roll 11, in combination with the recessed portion 10.5 of eccentric guide roll 10, leads the signature to an upper signature stream path side of the extensions 31. As the eccentric rolls 10, 11 continue to rotate, the increasing height of the protrusion 11.3 as it rotates from its minimum 11.2 towards its maximum 11.4, in combination with the recessed portion 10.5 of the lobes 10.1, continues to lead the signature to the upper signature stream path.

In FIG. 2, the diverter mechanism 100 is shown in position to divert a subsequent signature 15' to the lower signature stream path in direction 1.2. Diverter 30 is now in its second position, with it is extensions 31 closer to lobes 10.1. As shown, the tail 15.2 of the prior signature 15 is on the upper stream path side of the extensions 31, and the protrusions 11.3 of the lobes 11.1 are downstream of the tips of the extensions 31. As the head 15.1' of the signature 15' approaches the diverter 30 in FIG. 2, the eccentric protrusion 10.3 of eccentric guide roll 10, in combination with the recessed portion 11.5 of eccentric guide roll 11, leads the signature to a lower signature stream path side of the extensions 31. As the eccentric rolls 10, 11 continue to rotate, the increasing height of the protrusion 10.3 as it rotates from its minimum 10.2 towards its maximum 10.4, in combination with the recessed portion 11.5 of the lobes 11.1, continues to lead the signature to the lower signature stream path.

The diverter mechanism 100 may be driven by one or more motors. For example, a single motor could be provided to drive eccentric rolls 10, 11 and diverter 30. In such an embodiment, the rolls 10 and 11 could be driven in common by a motor through a gear train, and a cam could also be driven by the motor with the movement of the diverter being controlled by the interaction of the cam and a cam follower. Alternatively, the diverter 30 could be driven by a separate motor. Transport tapes 20, 21, 22, and 23 may be driven by the same motor as the rolls 10, 11 and/or diverter, or by one or more other motors. Other drive arrangements could also be provided. In order to divert every signature (i.e. so that adjacent signatures travel in different paths as illustrated in FIGS. 1 and 2), the eccentric rolls 10, 11 rotate at 2 time the speed of the signatures, such that two signatures pass through the diverter for every revolution of the rolls 10,11. In such an embodiment, the diverter changes position for each signature. In order to divert every other signature (i.e. so that two adjacent signature travel to the upper path, followed by two adjacent signatures to the lower path), the eccentric rolls 10, 11 may rotate at from 1 to 1.5 times the speed of the signatures, and the diverter changes position for every other signature.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An apparatus for transporting signatures, comprising:

a moving transport surface for transporting signatures;

a pair of eccentric guide rollers, rotatable about respective axes, the pair of guide rollers positioned opposite one another to receive signatures therebetween from the moving transport surface; and a diverter positioned downstream of the guide rollers, the diverter movable between a first position to divert signatures received from the guide rollers to a first downstream moving transport surface and a second position to divert signatures received from the guide rollers to a second downstream moving transport surface.

2. The apparatus according to claim 1, wherein the pair of eccentric guide rollers each include a first outer circumferential surface having an eccentric protrusion and a second outer circumferential surface recessed relative to the first outer circumferential surface, the eccentric protrusion being tapered from a first height to a second height, greater than the first height.

3. The apparatus according to claim 2, wherein the pair of eccentric guide rollers are positioned such that, as the guide rollers rotate, the first outer circumferential surface of one guide roller faces the second outer circumferential surface of the other guide roller.

4. The apparatus according to claim 3, wherein each of the eccentric guide rollers include a plurality of lobes, each of the plurality of lobes including a first outer circumferential surface having an eccentric protrusion and a second outer circumferential surface recessed relative to the first outer circumferential surface, the eccentric protrusion being tapered from a first height to a second height, each of the lobes being separated from an adjacent one of the lobes by a space.

5. The apparatus according to claim 4, wherein the moving transport surface comprises a plurality of first transport tapes and a plurality of second transport tapes transporting signatures therebetween, the plurality of first transport tapes passing through the spaces in one of the eccentric guide rollers, the plurality of second transport tapes passing through spaces in the other eccentric guide roller.

6. The apparatus according to claim 5, further comprising a plurality of third transport tapes and a plurality of fourth transport tapes downstream of the diverter, the plurality of first transport tapes and the plurality of third transport tapes forming the first downstream moving transport surface, the plurality of second transport tapes and the plurality of fourth transport tapes forming the second downstream moving transport surface.

7. The apparatus according to claim 4, wherein the diverter includes a plurality of substantially triangular extensions having spaces therebetween, the spaces aligned with the plurality of lobes.

8. The apparatus according to claim 1, wherein the moving transport surface comprises a plurality of first transport tapes and a plurality of second transport tapes transporting signatures therebetween, the plurality of first transport tapes passing through the spaces in one of the eccentric guide rollers, the plurality of second transport tapes passing through spaces in the other eccentric guide roller.

9. The apparatus according to claim 8, further comprising a plurality of third transport tapes and a plurality of fourth transport tapes downstream of the diverter, the plurality of first transport tapes and the plurality of third transport tapes forming the first downstream moving transport surface, the plurality of second transport tapes and the plurality of fourth transport tapes forming the second downstream moving transport surface.

10. The apparatus according to claim 1, wherein the diverter is substantially triangular in shape.

11. A method for transporting signatures, comprising:

moving signatures along a common transport path;

rotating a pair of eccentric guide rollers, about respective axes, the pair of guide rollers positioned opposite one another to receive signatures therebetween from the common transport path; and moving a diverter positioned downstream of the guide rollers between a first position to divert signatures received from the guide rollers to a first downstream transport path and a second position to divert signatures received from the guide rollers to a second downstream transport path.

12. The method of claim 11, wherein the pair of eccentric guide rollers each include a first outer circumferential surface having an eccentric protrusion and a second outer circumferential surface recessed relative to the first outer circumferential surface, the eccentric protrusion being tapered from a first height to a second height, greater than the first height, and wherein the step of rotating comprises rotating the pair of eccentric guide rollers such that, as the guide rollers rotate, the first outer circumferential surface of one guide roller faces the second outer circumferential surface of the other guide roller.

13. The method of claim 12, wherein the step of rotating comprises diverting a path of the signature towards the first downstream transport path with the eccentric protrusion of one of the eccentric guide rollers, and diverting a path of the signature towards the second downstream transport path with the eccentric protrusion of the other of the eccentric guide rollers.

14. The method of claim 12, wherein the step of rotating comprises rotating the eccentric guide rollers at twice the speed of the moving signatures.

15. The method of claim 14, wherein the step of moving the diverter comprises moving the diverter to divert one signature to the first downstream signature path and an adjacent signature to the second downstream signature path.

16. The method of claim 12, wherein the step of rotating comprises rotating the eccentric guide rollers at 1.5 times the speed of the moving signatures.

17. The method of claim 16, wherein the step of moving the diverter comprises moving the diverter to divert one pair of adjacent signatures to the first downstream signature path and a next pair of adjacent signatures to the second downstream signature path.

18. An apparatus for transporting signatures, comprising:

a moving transport surface for transporting signatures, the moving transport surface including a plurality of first transport tapes and a plurality of second transport tapes transporting signatures therebetween;

a pair of eccentric guide rollers, rotatable about respective axes, the pair of guide rollers positioned opposite one another to receive signatures therebetween from the moving transport surface, each of the eccentric guide rollers including a plurality of lobes, each of the plurality of lobes including a first outer circumferential surface having an eccentric protrusion and a second outer circumferential surface recessed relative to the first outer circumferential surface, the first outer circumferential surface of each eccentric protrusion being tapered from a first height at a first end thereof to a second height at a second end thereof, each of the lobes being separated from an adjacent one of the lobes by a space, the plurality of first transport tapes passing through the spaces in one of the eccentric guide rollers, the pair of eccentric guide rollers positioned such that, as the guide rollers rotate, the first outer circumferential surface of one guide roller faces the second outer circumferential surface of the other guide roller, the plurality of second transport tapes passing through spaces in the other eccentric guide roller;

a plurality of third transport tapes and a plurality of fourth transport tapes, the plurality of first transport tapes and the plurality of third transport tapes forming a first downstream moving transport surface, the plurality of second transport tapes and the plurality of fourth transport tapes forming a second downstream moving transport surface; and a diverter positioned downstream of the guide rollers and upstream of the third and fourth transport tapes, the diverter movable between a first position to divert signatures received from the guide rollers to the first downstream moving transport surface and a second position to divert signatures received from the guide rollers to the second downstream moving transport surface.

19. The apparatus according to claim 18, wherein the diverter includes a plurality of substantially triangular extensions having spaces therebetween, the spaces aligned with the plurality of lobes.

* * * * *